US005651477A

United States Patent [19]

Takahashi et al.

[11] Patent Number: 5,651,477

[45] Date of Patent: Jul. 29, 1997

[54] CONSTANT QUANTITY INJECTION VALVE FOR LIQUEFIED CARBON DIOXIDE GAS

[75] Inventors: Masaki Takahashi, Kashiwa; Ichiro Fumino, Tokyo, both of Japan

[73] Assignee: Nippon Tansan Gas Company Limited, Tokyo, Japan

[21] Appl. No.: 409,876

[22] Filed: Mar. 24, 1995

[30] Foreign Application Priority Data

Apr. 1, 1994 [JP] Japan ..... 6-085236

[51] Int. Cl.[6] ..... B65D 83/14

[52] U.S. Cl. ..... 222/3; 222/5; 222/82; 222/402.2

[58] Field of Search ..... 222/402.1, 402.2, 222/80–82, 3, 5

[56] References Cited

U.S. PATENT DOCUMENTS

| | | | |
|---|---|---|---|
| 2,667,991 | 2/1954 | Boyer | 222/82 |
| 2,781,950 | 2/1957 | Pritchard | 222/82 |
| 2,991,917 | 7/1961 | Ward | 222/402.2 |
| 3,235,135 | 2/1966 | Robert et al. | 222/402.2 X |
| 3,260,418 | 7/1966 | Clouzeau et al. | 222/402.2 |
| 3,352,464 | 11/1967 | Frangos | 222/402.2 |
| 3,394,851 | 7/1968 | Gorman | 222/402.2 |
| 3,605,738 | 9/1971 | Ciranna | 222/402.2 |
| 4,220,258 | 9/1980 | Gruenewald | 222/402.2 X |
| 4,666,062 | 5/1987 | Pershall | 222/82 |
| 4,811,868 | 3/1989 | Nitta | 222/402.2 |

FOREIGN PATENT DOCUMENTS

| | | | |
|---|---|---|---|
| 233796 | 10/1959 | Australia | 222/402.2 |

*Primary Examiner*—Kevin P. Shaver

*Attorney, Agent, or Firm*—Lackenbach Siegel Marzullo Aronson & Greenspan, PC

[57] ABSTRACT

The constant quantity injection valve (1) comprises a valve housing (2), a first and a second valve (3, 4) respectively including valve pins (8, 9) and ring-like packings (10, 11), and a measuring chamber (5) formed in the valve housing between the two valves. The valve housing has a gas blow-out passage extending along its axis. The individual valves are located on the upstream and downstream sides (*7a*, *7b*) of the blow-out passage, and the valve pins are axially movable and respectively include closing sections (12, 13), opening sections (14, 15) and inclined sections (16, 17) connecting the two sections. The ring-like packings are made of an elastic material with a rubber hardness of 90° or above, the three sections of each of the valve pins being detachably mounted on the peripheral wall of the blow-out passage. The two valves are in a position relation to each other such that with the closing of the first valve the second valve communicate the measuring chamber with the downstream side and with the opening of the first valve the second valve communicates the measuring chamber with the downstream side.

9 Claims, 4 Drawing Sheets

CONSTANT QUANTITY INJECTION VALVE FOR LIQUEFIED CARBON DIOXIDE GAS

BACKGROUND OF THE INVENTION

1. Field of the Invention

This invention relates to constant quantity injection valves for liquefied carbon dioxide gas and also to injectors and injection apparatus using such valves.

2. Description of the Prior Art

Quantitative injection apparatuses used in connection with asthma or the like use furon as propellant. Furon is under comparatively low pressure. Packing materials such as rubber have low permeability to furon, and it is not so difficult to maintain seal against furon.

(Problems to be Solved According to the Invention)

Furon is raising problems such as destruction of ozone layer, and its use will be prohibited in the future. When realizing the adoption of liquefied carbon dioxide gas as a substitute propellant, it is important that the pressure of the gas is very high compared to furon, that is, the gas pressure is about 60 to 70 kgf/cm2 even at normal temperature.

Therefore, the following problems are posed.

(1) Restriction is imposed on the structure of the valve pins of the first and second valves.

In case of first and second constant quantity valves interlocked to each other for leading gas into and out of a measuring chamber, particularly in case of valves having ring-like packings and valve pins cooperating with one another, the valve pins being moved to repeat the closing and opening of a gas passage, if it is intended to form the valve pins with local notches and transversal holes for the gas passage, stress concentration is caused in ring-like packing portions in contact with the notches, transversal holes, etc. to result in breakage, that is, such processing is impossible.

(2) The packing material such as rubber is highly permeable to the gas, and volume expansion, i.e., inflation, of the ring-like packings is prone.

As the inflation of the ring-like packings proceeds, the pushing forces of the valve pins are increased to increase the frictional forces with respect to the ring-like packings. The ring-like packings are thus worn out soon. When the inflation proceeds to such an extent that the volume of the ring-like packings exceeds the volume of the accommodating unit, the pushing forces for inserting the closing sections of the valve pins into the ring-like packings are extremely increased, thus making the use difficult or impossible. If it is intended to insert irrationally, damage to the ring-like packings is prone.

To solve the above problems, the structure of the valves and the hardness of the ring-like packing materials are taken into considerations, and it is an object of the invention to provide a constant quantity injection valve which permits use of liquefied carbon dioxide gas and also provide an injector and an injecting apparatus using such a valve.

SUMMARY OF THE INVENTION

It is an object of the present invention to provide a constant quantity injection valve which, in case of using liquefied carbon dioxide gas instead of furon as propellant, is available against a high pressure.

Another object of the present invention is to provide an injector using the same constant quantity injection valve.

A further object of the present invention is to provide an injecting apparatus using the same constant quantity injection valve.

An annular packing which effectively seal together with a valve pin the flow of gases.

The foregoing objects and other objects as well as the characteristic features of the invention will become more apparent and more readily understandable by the following description and the appended claims when read in conjunction with the accompanying drawings.

(Means for Solving the Problems)

The constant quantity injection valve for liquefied carbon dioxide gas according to the invention comprises a valve housing, a first and a second valve interlocked to each other, and a measuring chamber formed in the valve housing between the two valves. The valve housing has a gas flow-out passage extending along its axis. The two valves respectively are located on the upstream and downstream sides of the flow-out path and have valve pins and ring-like packings. The valve pins are axially movable and have closing sections, opening sections and inclined sections connecting the two sections. The ring-like packings are made of an elastic material with a rubber hardness of 90° or above. The closing sections, inclined sections and opening sections of the valve pins are detachably provided on the peripheral wall of the flow-out passage.

The two valves are in a position relation to each other such that with the closing of the first valve the second valve communicates the measuring chamber with the downstream side and with the opening of the first valve the second valve is closed to communicate the measuring chamber with the upstream side.

If the returning of the valve pins is insufficient with the sole gas pressure, a valve pin returning spring may be provided between each valve pin and the valve housing.

In the injector using the constant quantity injection valve for liquefied carbon dioxide gas according to the invention, the constant quantity injection valve for liquefied carbon dioxide gas having the above construction is mounted such as to be in close contact with an opening of a small size, high pressure gas vessel. Further, a cap having an issuing port is slidably fitted on the vessel such as to cover the injection valve let its inner surface engage the heat of the valve pin of the second valve.

In the injection apparatus using the constant quantity injection valve for liquefied carbon dioxide gas according to the invention, a cutter of a small size, high pressure gas vessel is provided in communication with and on the upstream side of the constant quantity injection valve for Liquefied carbon dioxide gas. Further, a cap having an issuing port is slidably fitted on the valve housing such as to cover the injection valve and let its inner surface engage the head of the valve pin of the second valve.

In either of the above three cases, the ring-like packings of the constant quantity injection valve for Liquefied carbon dioxide gases are made of polyurethane. Further, in either of the above three cases, the ring-like packings of the constant quantity injection valve for liquefied carbon dioxide gas are made of a polyester type elastic material.

(Functions)

In the case of the constant quantity injection valve, the flow-out passage in the valve housing has its first valve side led to the liquefied carbon dioxide gas side. The valve pin is pushed from the first valve side to the second valve side by spring or with gas pressure. The first valve is opened, and the second valve is closed. The gas is led through the first valve to fill the measuring chamber.

In this case, as the head of the valve pin of the second valve is pushed, the valve pin of the first valve is moved, thus first closing the first valve and then opening the second valve. Thus, a predetermined quantity of gas in the measuring chamber is released to the outside.

When the valve pin of the second valve is released, it is pushed to the original position by the restoring force of the gas pressure or spring if there is such gas pressure or spring, and the valve pin of the first valve is interlocked. Then, first the second valve is closed, and then the first valve is opened, thus filling the measuring chamber with new pressurized gas.

Thus, it is possible to cause injection of a constant quantity of gas repeatedly by repeatedly causing the pushing and releasing of the valve pin of the second valve.

Since the valve pins of the first and second valves are not formed with notches or transversal holes for gas passage, the ring-like packings are free from stress concentration portions and are not damaged.

Further, the ring-like packings have a hardness of 90° or above, and inflation does not result due to liquefied carbon dioxide gas. Thus, there is neither operating force change nor damage to the ring-like packings, and it is possible to minimize the sectional area of the seal. It is thus possible to simplify the valve structure, reduce the operating force and permit ready general use.

In case of the injector, the vessel is filled with liquefied carbon dioxide gas. By pushing the cap the valve pin of the second valve, and the valve pin of the first valve is interlocked to this action. Thus, like the case of the above constant quantity injection valve, a constant quantity of liquefied carbon dioxide gas is released. It is thus possible to repeat injection of a constant quantity of gas by repeatedly causing the pushing and releasing of the cap.

In case of the injection apparatus, a small size, high pressure gas vessel filled with liquefied carbon dioxide gas is mounted in a cutter of the injection apparatus. A sealing member of the vessel is cut by the cutter, causing the inner gas to be led through the first valve and fill the measuring chamber.

At this time, by pushing the cap the valve pin of the second valve is pushed, and as in the above constant quantity injection valve, the valve pin of the first valve is interlocked to this action, causing the release of a constant quantity of liquefied carbon dioxide gas. It is thus possible to cause injection of a constant quantity of gas repeatedly by repeatedly causing the pushing and releasing of the cap.

Ring-like packings made of polyurethane are excellent in inflation resistance, and with their fitting on the valve pins it is possible to obtain satisfactory sliding and seal of the valve pins.

Ring-like packings made of a polyester type elastic material, are excellent in inflation resistance, and their seal property is not spoiled even when they are repeatedly engaged with and disengaged from the closing sections of the valve pins.

DETAILED DESCRIPTIONS OF THE INVENTION

Figure 1:
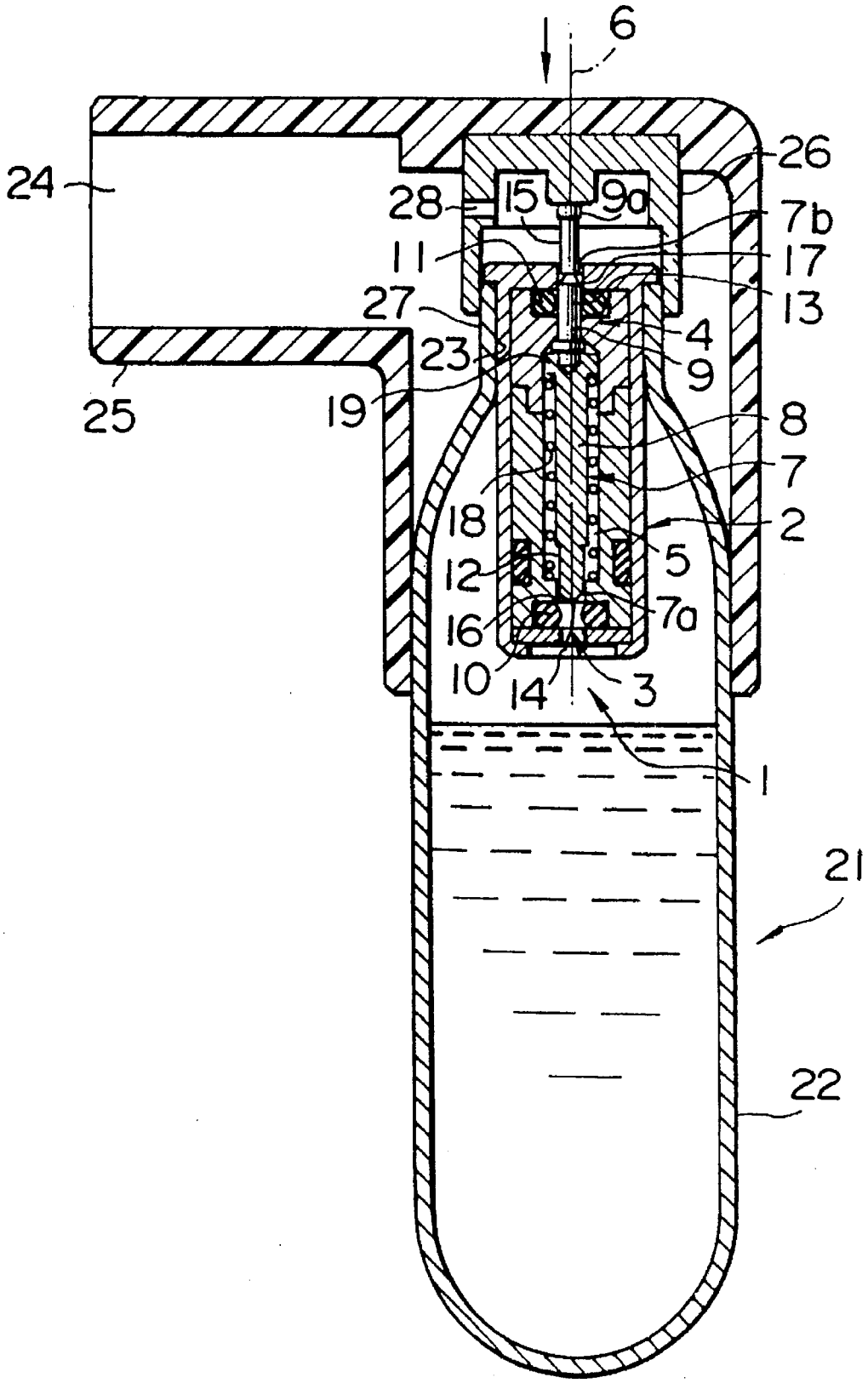
FIG. 1 is a sectional view showing a specific example of the constant quantity injection valve for liquefied carbon dioxide gas and an injector using the injection valve according to the invention.
Figure 2:
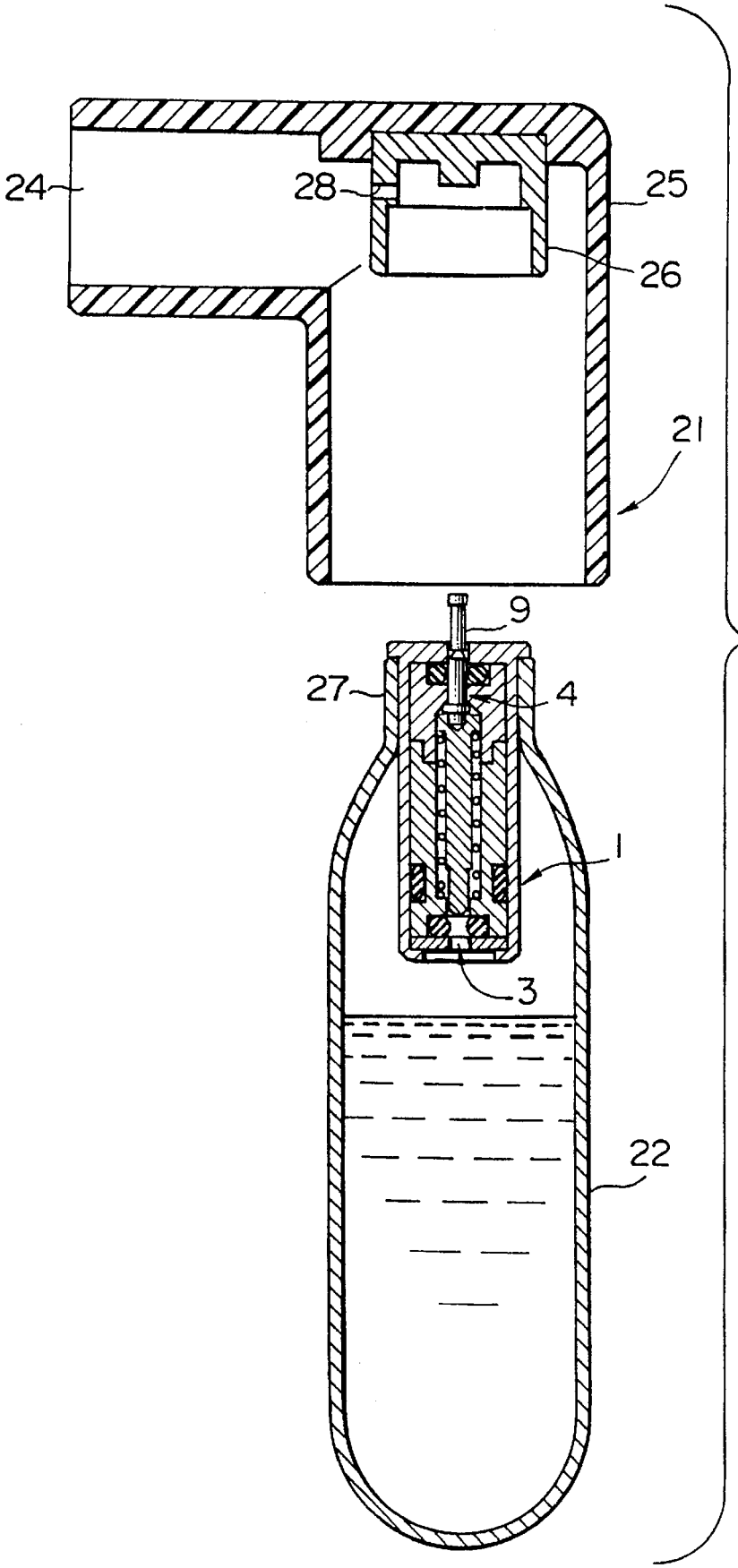
FIG. 2 is a sectional view showing the same structure with a cap removed.
Figure 3:
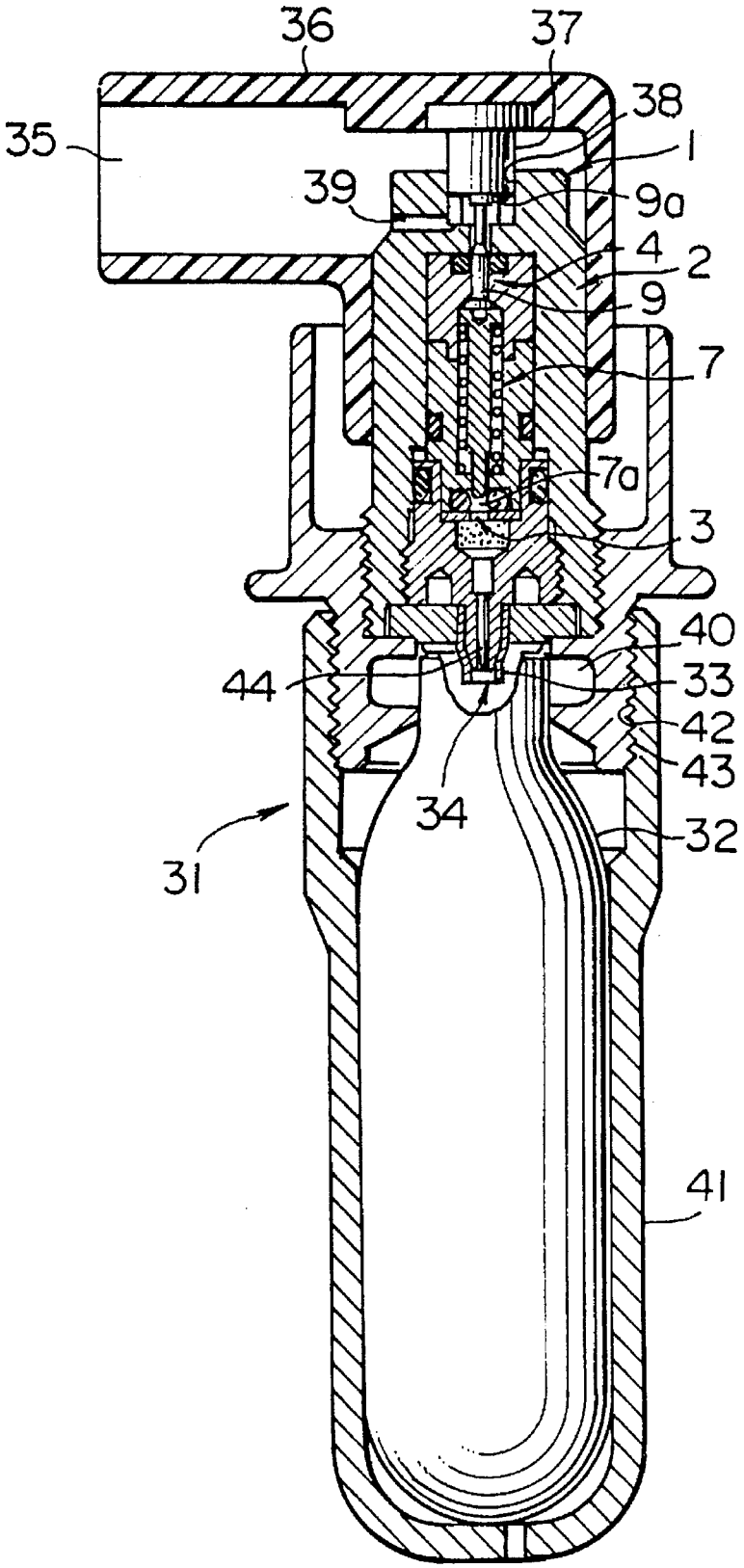
FIG. 3 is a sectional view showing a specific example of the injection apparatus using the constant quantity injection valve for liquefied carbon dioxide gas according to the invention.

Referring to FIGS. 1 to 3, designated at 1 is a constant quantity injection valve, which comprises a valve housing 2, a first and a second valve 3 and 4 respectively interlocked to each other, and a measuring chamber 5 formed in the halve housing 2 between the two valves 3 and 4.

The valve housing 2 has a gas flow-out passage 7 extending along its axis.

The two valves 3 and 4, respectively, are located on the upstream and downstream sides *7a* and *7b* of the flow-out passage 7 and have valve pins 8 and 9 and ring-like packings 10 and 11. The two valve pins 8 and 9 are interlocked to each other. In the illustrated case, the valve pins 8 and 9 are separate members and are abutted to each other. However, it is possible as well that they are made integral by screwing or they are formed together as a one-piece molding. Further, the two valve pins 8 and 9 are suitably made of stainless steel for maintaining the smoothness of movement.

The two valve pins 8 and 9 are axially movable, and they respectively have closing sections 12 and 13, opening sections 14 and 15 and inclined sections 16 and 17 connecting the two sections. In the illustrated example, the opening section 14, unlike the opening section 15, is not axis-like but is a sort of void-like. However, it may be axis-like. The ring-like packings 10 and 11 are made of an elastic material with rubber hardness of 90° or above, and each ring-like packing 10 or 11 is disposed, engageably and disengageably with each closing section 12 or 13, inclined section 16 or 17 or opening section 14 or 15 of each valve pin 8 or 9 on the peripheral wall of the flow-out passage 7.

The ring-like packings 10 and 11 suitably have a rubber hardness of 93°. If their rubber hardness is 87°, they are inflated to an extent to disable valve operation and also undergo shape changes.

The two valves 3 and 4 are in a position relation such that with the closing of the first valve 3 the second valve 4 communicates the measuring chamber 5 with the downstream side *7b*, while with the opening of the first valve 3 the second valve 4 is closed to communicate the second valve 4 with the upstream side *7a*.

Designated at 18 is a spring for moving the valve pin 8 in one direction. The spring 18 is provided between a flange 19 of the valve pin 8 and measuring chamber end wall of the valve housing 2.

In FIGS. 1 and 2, designated at 21 is an injector. The constant quantity injection valve 1 is mounted such that it is in close contact with an open portion 23 of a small size high pressure gas vessel 22. A cap 25 having an issuing port 24 is fitted on the vessel 22 to cover the constant quantity injection valve 1 and engage its inner surface With a head *9a* of the valve pin 9 of the second valve 4. In this engaging part, an auxiliary cap 26 as shown is slidably fitted on a neck 27 of the vessel 22, and the peripheral wall of the auxiliary cap 26 is provided with a port 28 directed to the issuing port 24. This arrangement permits smoothness of the movement of the cap 25 and flow-out of gas.

Figure 4:
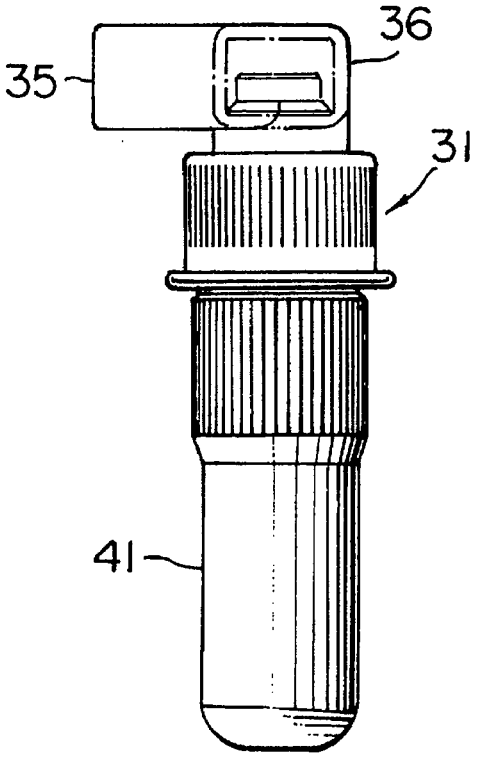
FIGS. 4 and 5 are perspective views of the injector.
Figure 5:
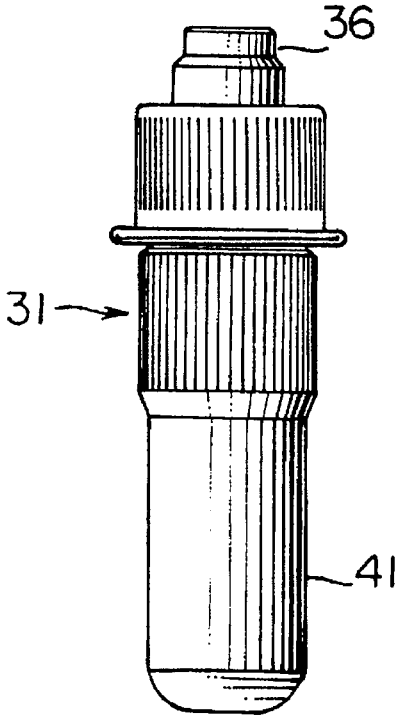

FIGS. 3 to 5 show the injection apparatus. A cutter 34 for cutting a sealing sheet 33 on the high pressure gas vessel 32 and is provided on the upstream side *7a* of the flow-out passage 7 such that it is interlocked to the first valve 3 of the constant quantity injection valve 1. A cap 36 having an issuing port 35 is slidably fitted on valve housing 2 such as to cover the constant quantity injection valve 1 such that its inner surface is engages head *9a* of valve pin 9 of second valve 4.

In the engaging part, a depending portion 37 as shown is provided such that it is slidably fitted in a recess 38 provided in the top of valve housing 2, and the peripheral wall of the recess 38 is provided with a port 39 directed to the issuing port 35. This arrangement permits smoothness of the movement of the cap 36 and the flow-out of gas.

In the case of the illustrated injection apparatus 31, the neck 40 of the vessel 32 has no thread. It is adapted that the vessel 32 is fitted in a holder 41 and that a screw 42 at an opening of the holder 41 is screwed in a mounting thread 42 of the cutter 34 for cutting the sealing sheet 32 with a needle 44. In case where the neck 40 has a thread, it is possible to dispense with the holder 41 by mounting the vessel 32 directly on the cutter 34.

The opening section 14 of the valve pin 8 of the first valve 3 of the constant quantity injection valve 1 may be made to be void-like. The ring-like packings 10 and 11 may be made of polyurethane or polyester type elastic material. The valve pins 8 and 9 engage smoothly, have satisfactory sealing properties and have an excellent inflating property. These properties can be further improved by using stainless steal for the valve pins 8 and 9.

With the constant quantity injection valve for liquefied carbon dioxide gas according to the invention, in which the first and second valves are located on the upstream and downstream sides of the gas flow-out passage, by leading the upstream side to a liquefied carbon dioxide gas source and leading the downstream side to atmosphere, a constant quantity of high pressure gas can be taken out with valve pin operation. In addition, the valve pins of the first and second valve pins do not have any notch or transversal hole for gas passage, no damage is caused to the ring-like packings by stress concentration. Further, since the ring-like packings have a rubber hardness of 90° or above, their inflation by liquefied carbon dioxide gas is not caused, and thus they are free from deformation. It is thus possible to ensure reliable valve function.

With the injector using the constant quantity injection valve for liquefied carbon dioxide gas, it is possible to take out a .constant quantity of liquefied carbon dioxide gas at all times by repeating the operations of pushing and releasing the cap.

With the injection apparatus using the constant quantity injection valve for liquefied carbon dioxide gas, it is possible to make preparations for gas supply by merely mounting a small size, high pressure gas vessel in a cutter, thus permitting release of a constant quantity of gas by repeating the operations of pushing and releasing the cap.

Further, in the state of engagement with the valve pins it is possible to obtain satisfactory sliding of the valve pins and a reliable seal.

Further, no seal is weakened with the repetitive engagement and disengagement of the closing sections of the valve pins.

What I claim are:

1. A constant quantity injection valve (1) for liquefied carbon dioxide gas cartridge comprising a valve housing (2), a first valve (3) and a second valve (4) interlocked to each other, and a measuring chamber (5) formed in the valve housing (2) between the two valves (3, 4);

the valve housing (2) having a gas flow-out passage (7) formed along its axis (6);

the two valves (3, 4) respectively being located on the upstream side *7a* and downstream side *7b* of the flow-out passage (7); the two valves (3, 4) respectively having valve pins (8, 9) and ring-like packings (10, 11); the valve pins (8, 9) being axially movable and respectively having closing sections (12, 13), opening sections (14, 15) and inclined sections (16, 17) connecting the closing sections (12, 13) and the opening sections (14, 15); the ring-like packings (10, 11) being made of an elastic material with a rubber hardness of 90° or above, and being disposed on the peripheral wall pf the flow-out passage (7), the ring-like packings (10, 11) respectively being engageably and disengageably with each closing section (12, 13), inclined section (16, 17) and opening section (14, 15) of each valve pin (8, 9);

the two valves (3, 4) being in a position relative to each other such that with the closing of the first valve (3) the second valve (4) communicates the measuring chamber (5) with the downstream side (*7b*) and with the opening of the first valve (3) the second valve (4) is closed to communicate the measuring chamber (5) with the upstream side (*7a*).

2. The constant quantity injection valve for liquefied carbon dioxide gas according to claim 1, wherein the ring-like packings (10, 11) are made of polyurethane.

3. The constant quantity injection valve for liquefied carbon dioxide gas according to claim 1, wherein the ring-like packings (10, 11) are made of a polyester type elastic material.

4. An injector using a constant quantity injection valve for liquefied carbon dioxide gas cartridge (22), wherein a constant quantity injection valve (1) for the liquefied carbon dioxide gas, comprising: a valve housing (2), a first valve (3) and a second valve (4) interlocked to each other, and a measuring chamber (5) formed in the valve housing (2) between the two valves (3, 4);

the valve housing (2) having a gas flow-out passage (7) formed along its axis (6);

the two valves (3, 4) respectively being located on the upstream side *7a* and downstream side *7b* of the flow-out passage (7); the two valves (3, 4) respectively having valve pins (8, 9) and ring-like packings (10, 11); the valve pins (8, 9) being axially movable and respectively having closing sections (12, 13), opening sections (14, 15) and inclined sections (16, 17) connecting the closing sections (12, 13) and the opening sections (14, 15); the ring-like packings (10, 11) being made of an elastic material with a rubber hardness of 90° or above, and being disposed on the peripheral wall pf the flow-out passage (7), the ring-like packings (10, 11) respectively being engageably and disengageably with each closing section (12, 13), inclined section (16, 17) and opening section (14, 15); of each valve pin (8, 9);

the two valve (3, 4) being in a position relative to each other such that with the closing of the first valve (3) the second valve (4) communicates the measuring chamber (5) with the downstream side (*7b*) and with the opening of the first valve (3) the second valve (4) is closed to communicate the measuring chamber (5) with the upstream side (*7a*); is mounted in close contact with an opening (23) of the gas cartridge (22), a cap (25) having an issuing port (24) being slideably fitted on the cartridge (22) such as to cover the injection valve (1), and the inner surface of the cap (25) being engaged with a head of the valve pin (9) of the second valve (4).

5. The injector using the constant quantity injection valve for liquefied carbon dioxide gas according to claim 4, wherein the ring-like packings (10, 11) are made of polyurethane.

6. The injector using the constant quantity injection valve for liquefied carbon dioxide gas according to claim 4, wherein the ring-like packings (10, 11) are made of a polyester type elastic material.

7. An injection apparatus using a constant quantity injection valve for liquefied carbon dioxide gas cartridge (22), wherein the constant quantity injection valve (1), for liquefied carbon dioxide gas comprising a valve housing (2), a first valve (3) and a second valve (4) interlocked to each other, and a measuring chamber (5) formed in the valve housing (2) between the two valves (3, 4);

the valve housing (2) having a gas flow-out passage (7) formed along its axis (6);

the two valves (3, 4) respectively being located on the upstream side 7*a* and downstream (demand side 7*b*) of the flow-out passage (7); and having valve pins (8, 9) the two valves (3, 4) respectively ring-like packings (10, 11); the valve pins (8, 9) being axially movable and respectively having closing sections (12, 13), opening sections (14, 15) and inclined sections (16, 17) connecting the closing sections (12, 13) and the opening sections (14, 15); the ring-like packings (10, 11) being made of an elastic material with a rubber hardness of 90° or above, and being disposed on the peripheral wall pf the flow-out passage (7), the ring-like packings (10, 11) respectively being engageably and disengageably with each closing section (12, 13), inclined section (16, 17) and opening section (14, 15) of each valve pin (8, 9);

the two valves (3, 4) being in a position relative to each other such that with the closing of the first valve (3) the second valve (4) communicates the measuring chamber (5) with the downstream side (7*b*) and with the opening of the first valve (3) the second valve (4) is closed to communicate the measuring chamber (5) with the upstream side (7*a*); a cutter (34) for cutting the gas cartridge (22) is provided in communication with and on the upstream cartridge side (7*a*) of the first valve (3), a cap (25) having an issuing port (24) being slidably fitted on the valve housing (2) such as to cover the injection valve (2), the inner surface of the cap (25) being engaged with a head of the valve pin (9) of the second valve (4).

8. The injection apparatus using the constant quantity injection valve for liquefied carbon dioxide gas according to claim 7, wherein the ring-like packings (10, 11) are made of polyurethane.

9. The injection apparatus using the constant quantity injection valve for liquefied carbon dioxide gas according to claim 7, wherein the ring-like packings (10, 11) are made of a polyester type elastic material.

* * * * *